United States Patent [19]

Seider

[11] 3,973,898

[45] Aug. 10, 1976

[54] AUTOMATIC COMBUSTION CONTROL WITH IMPROVED ELECTRICAL CIRCUIT

[76] Inventor: Seymour Seider, 220 Willow Pond Lane, Hewlett Harbor, N.Y. 11557

[22] Filed: Nov. 18, 1974

[21] Appl. No.: 524,462

Related U.S. Application Data

[63] Continuation-in-part of Ser. No. 426,323, Dec. 19, 1973, Pat. No. 3,861,855.

[52] U.S. Cl. ..... 431/76; 236/15 E; 431/12; 431/9 U

[51] Int. Cl.[2] ..... F23N 5/08

[58] Field of Search ..... 431/76, 90, 79, 12; 236/15 E

[56] References Cited

UNITED STATES PATENTS

| | | | |
|---|---|---|---|
| 3,549,089 | 12/1970 | Hamlett | 236/15 E |
| 3,701,622 | 10/1972 | DuCasse | 431/76 |
| 3,723,047 | 3/1973 | deLivois | 431/76 |
| 3,814,570 | 6/1974 | Guigues et al. | 431/76 |
| 3,829,276 | 8/1974 | Lenski et al. | 431/79 |
| 3,482,922 | 12/1969 | Blackett | 431/79 X |

*Primary Examiner*—Edward G. Favors
*Attorney, Agent, or Firm*—Roberts & Cohen

[57] ABSTRACT

Combustion control is effected by the use of a smoke detector and by solid state devices for the detection and amplification of electrical signals produced by a photoelectric cell for the purpose of controlling a motor which in turn adjusts fuel and air supplies. The electrical circuits include triac switches effective for running a servo-mechanism or motor in one direction or the other according to the density of the smoke in a flue venting combustion products from a combustion chamber. Light emitting diodes may be connected to op-amps for purposes of indicating the type of control being effected. A smoke accumulating means is employed for amplifying the products of combustion to facilitate the detecting and measuring of the same.

12 Claims, 3 Drawing Figures

E
A
B
C
D
F
LED 1
LED 2
LED 3
LED 4
301
301a
301b
302
302a
302b
303
303a
303b
304
304a
304b
305
305a
306
MULTI-PLEXER
307
308
309
310
311
312
313
314
315
316
317
318
319
320
350
352
354
356
358
360
362
364
366
368
370
372
374
376
380
382
384
386
388
390
392
394
396
S2
S3
H
I
J
K
L
M
+6V DC
-6VDC
I.C.
F.F.
D Q
CLOCK
GATE
BURN. SOL. OIL VALVE
CONT. PROG.
BURNER ON/OFF -6VDC IF BURNER IS OFF
OSCILLATOR
HI/LOW FIRE -6V IF LOW FIRE
POSITION CONTROLLER
MOTOR
END SWITCH
OIL VALVE
PIN 14 +6VDC
PINS 6,4 10,8,7 -6VDC

AUTOMATIC COMBUSTION CONTROL WITH IMPROVED ELECTRICAL CIRCUIT

OTHER APPLICATION

This application is a continuation-in-part based on my copending Application Ser. No. 426,323 filed Dec. 19, 1973 and now U.S. Pat. No. 3,861,855, the contents of which are incorporated by reference.

FIELD OF INVENTION

This invention relates to combustion control apparatus including electronic circuits and, more particularly, to improved electronic circuits for use in connection with servo-mechanisms controlling the supply of fuel and air to combustion chambers.

BACKGROUND

In previously filed copending application Ser. No. 426,323 filed Dec. 19, 1973, it was proposed to measure the smoke density in the smoke pipe or flue of a furnace, by means of radiation from a uniformly radiating source such as an incandescent light bulb. The radiation falls on a photosensitive cell, preferably a cadmium-sulphide type cell, whose resistance to electrical flow varies with the intensity of the light impinging upon it. As the smoke interferes with the passage of light through the smoke pipe, and therefore regulates the quantity of light impinging upon the photocell, the resistance of the cell varies in inverse proportion to the quantity of smoke passing through the smoke pipe. However, as the level of smoke to be measured and maintained is very low in the pertinent range, a smoke gathering device or amplifier is used to concentrate the smoke level in the area of the light beam.

By applying a fixed voltage across the resistance of a divider network including the photocell, a varying voltage is created. This voltage is amplified and fed to a solid state analog-to-digital converter. This solid state converter creates, for example, a multi-bit word which represents the level of smoke detected by the photocell. These words trigger an appropriate triac switching circuit for controlling the resistance coupled to a modulating electric motor, in turn, controlling its position, thereby controlling the air-oil ratio of the furance and, finally, the smoke level in the smoke pipe.

The electrical circuit described in my copending application operates satisfactorily under most conditions. However, there are certain conditions in which improvement is possible. Thus, for example, the circuit of my copending application did not respond directly to different kinds of fuel which might be employed and, therefore, necessitated manual adjustment of the mechanical controls. Moreover, the original circuit described in my prior copending application operated in a manner which tended to be incremental whereas I have found that there are certain applications in which a more continuous type of operation is preferred.

SUMMARY OF INVENTION

It is an object of the invention to provide for an improved combustion control involving the use of improved electronic circuitry.

Another object of the invention is to provide an improved electronic control circuit for the above-noted type of apparatus which operates in a more continuous mode.

Yet another object of the invention is to provide for an improved control which operates despite the possible use of different types of fuel.

In achieving the above and other objects of the invention, there is provided a smoke control apparatus comprising a combustion chamber, means for supplying fuel and oxygen containing gas into said chamber, means for venting the products of combustion from said chamber, photoelectric means providing an electrical signal in accordance with the density of the thusly vented products of combustion, electrical circuit means for processing said electrical signal and servo-mechanism means operated by said circuit means to control the means for supplying fuel and oxygen containing gas to optimize the supply thereof and therefore said density. A smoke accumulating means is employed for amplifying the products of combustion to facilitate the detecting and measuring of the same.

In further accordance with the invention, the aforenoted circuit means comprises bridge means to control said servo-mechanism means, at least one first electronic switch operable when said density is equal to or less than a predetermined standard, at least one second electronic switch operable when said density is greater than said standard, said switches being coupled to and operating said bridge means and further means coupled to said photoelectric means and to said switches to operate the latter in response to levels of said signal whereby to control said servo-mechanism means through said bridge means.

According to a feature of the invention, the respective switches are connected across the bridge means. According to another feature of the invention, there are a plurality of the second type of switches having outputs connected in common to the bridge means.

According to yet another feature of the invention, visual indicators such as light emitting diodes are connected to the aforesaid op-amps which themselves may be in the form of triacs.

Yet another feature of the invention is to provide for remembering optimum or other conditions previously set and overriding more current signals therewith.

Other objects and features of the invention will be found in the detailed description which follows hereinafter.

DETAILED DESCRIPTION

Figure 1:
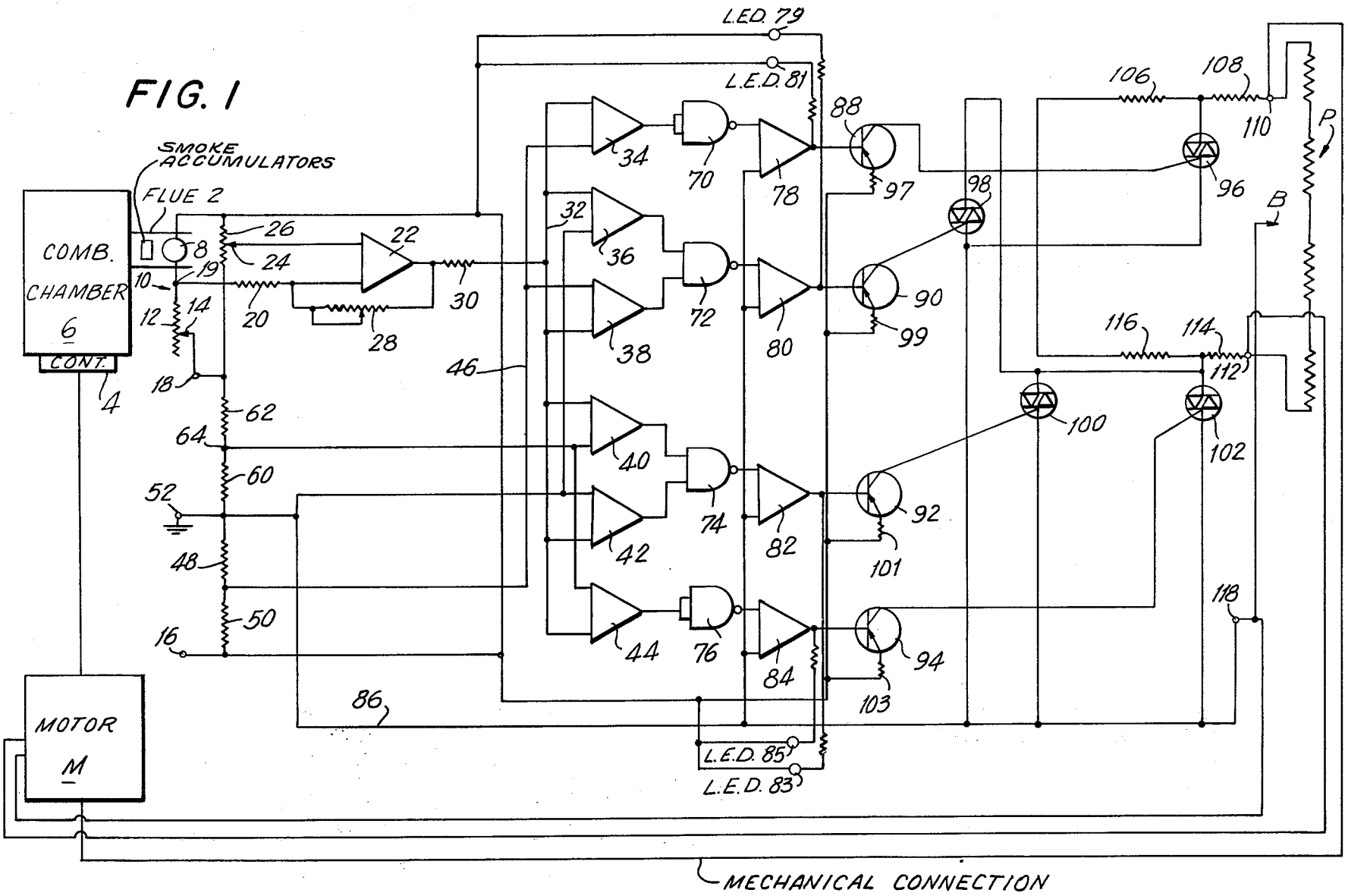
FIG. 1 is a diagrammatic representation of a smoke control for which there is illustrated in schematic diagram form an electronic control circuit.

FIG. 1 diagrammatically shows apparatus provided in accordance with the invention. This apparatus comprises a furnace or combustion chamber 6, a flue 2 for the venting of gases from the combustion chamber 6, an electronic control section which responds to a smoke detector, and a mechanical amplifier section described in said copending application. A photoelectric cell is indicated at 8 in the flue 2.

A modulating motor M operates a displaceable control 4 connected to an oil valve (not shown) which controls the amount of oil admitted into the burner of combustion chamber 6.

The control is also connected to a primary air damper (not shown) which controls the admission of air or other such oxygen containing gas into the burner and to a secondary air damper (not shown) by means of which control is effected on the amount of air which is admitted directly into the chamber 6.

A voltage divider is indicated generally at 10, said voltage divider including a variable resistor 12 and a brush 14. The voltage divider also includes the photoelectric cell 8. A voltage is applied across the voltage divider by means of terminals 16 and 18. Variable resistor 12 is preferably set to equal the photocell resistance at a no-smoke or preferred smoke level. As a result, any voltage variation at junction 19 will be an indication of the resistance variation of the photocell 8 and therefore an indication of the obscruation caused by the smoke passing through the light beam generated by the associated light source (not shown). A smoke accumulating means is employed for amplifying the products of combustion to facilitate the detecting and measuring of the same. The smoke accumulator is shown at S in FIG. 1.

The voltage appearing at junction 19 is fed into an amplifier 22 to raise its level. The voltage output of the amplifier is fed to an analog-to-digital converter. As described in the aforesaid copending application, the purpose of this converter is to change analog input from the preceding stage into a digital word output. This output is fed into a digital amplifier and triac switching section which first amplifies the digital word input to the necessary levels and then reads the input word in such a manner as to switch or gate one of a series of triac switches. This gating or switching section of the triac switches connects the common lead output of a resistor network to a different point in the network. As the network is connected in a potentiometer configuration, its three wire output is suitable for direct connection to a three-wire-input modulating type motor such as is employed to constitute the motor M.

For example, the total resistance across the potentiometer connected resistance network may be 135 ohms to match the input requirement of a Honeywell M 900 series modulating type motor. It can as well be very simply changed to the 270 ohms required by the same motor when used with other primary controls or to any desired value of resistance to match any input characteristic desired for any model of suitable modulating motor.

It is to be noted in the copending application that each triac gating switch in the amplifier and triac gate switch section is singly operated as the input signal strength reaches the particular quantization setting of that particular triac, which input signal is fed to it by the analog-to-digital converter.

As appears in FIG. 1, junction 19 is connected via a resistor 20 to the negative input of an operational amplifier 22. The positive input terminal of this operational amplifier is connected via a tap 24 on a resistor 26 which is connected across the photoelectric cell 8 and the variable resistor 12. The operational amplifier 22 has a variable feedback resistor 28 and the output of the operational amplifier 22 is connected via resistor 30 to line 32 which is connected to the positive input terminals of operational amplifier 34, 36 and 40 and to the negative input terminals of operational amplifiers 38, 42 and 44.

A line 46 is provided which is connected between resistors 48 and 50. Resistor 48 is connected to ground at a terminal 52. Line 46 is connected to the negative input terminal of operational amplifier 34 and to the positive input terminal of operational amplifier 38.

In addition to the above, there are further provided resistors 60 and 62 connected to a junction 64. Resistor 62 is connected to voltage source terminal 18 whereas resistor 60 is connected to ground at terminal 52. Junction 64 connected to the negative input of operational amplifier 40 and to the positive input of operational amplifier 44.

The output of operational amplifier 34 is connected to NAND gate 70. The outputs of operational amplifiers 36 and 38 are connected to NAND gate 72. The outputs of operational amplifiers 40 and 42 are connected to both inputs of NAND gate 74 and the output of operational amplifier 44 is connected to both inputs of NAND gate 76.

Also included in the illustrated circuit are operational amplifiers 78, 80, 82 and 84. The positive input terminal of operational amplifier 78 is connected to NAND gate 70 whereas the negative input of operational amplifier 28 is connected via line 86 to ground as are the negative input terminals of operational amplifiers 80, 82 and 84.

The positive input terminal of operational amplifier 80 is connected to the output of NAND gate 72 whereas the positive input terminals of operational amplifier 82 and 84 are connected to the outputs of NAND gates 74 and 76 respectively. The output terminals of operational amplifier 78, 80, 82 and 84 are respectively connected to transistors 88, 90, 92 and 94. The collectors of these transistors are respectively connected to triac switches 96, 98, 100 and 102. The emitters of the transistors are connected to + 6 volts at terminal 16 via resistors 97, 99, 101 and 103.

The output of triacs 98, 100 and 102 are connected to the junction of resistors 114 and 116. The output of triac 96 is connected to the junction of resistors 106 and 108. Resistor 106 is connected to resistor 116 and resistor 108 is connected via terminal 110 to motor M. Resistor 114 is connected via terminal 112 to motor M. Terminal 118 is connected to ground and to motor M as well as to brush B of potentiometer P. It has been found that this permits a much greater degree of sensitivity of response and range of control for motor M, thereby giving a much wider and more accurate range of control 4 of smoke levels as detected by the photocell 8.

Also shown in FIG. 1 is an indicating system which shows visually which gate is operative and hence what level of smoke is being detected by photocell 8. Light emitting diode (LED) 79 is connected to the output of amplifier 78. LED 81 is connected to the output of the amplifier 80, LED 83 is connected to the output of amplifier 82 and LED 85 is connected to the output of amplifier 82 and LED 85 is connected to the output of amplifier 84. These connections are made by limiting resistors. As each smoke level threshold is crossed, the related amplifier switches to turn on the associated triac and the corresponding LED is energized, giving a luminous indication. An alternating indication between LED 79 and LED 81 shows that motor M has adjusted the air/oil ratio to the set point on control potentiometer 24 and that the set level of smoke is being maintained. If LED 79, LED 83 or LED 85 is illuminated, the indication is that higher levels of smoke are being measured by photocell 8 than those preset by control pontentiometer 24. The converse is true if LED 81 is steadily illuminated. The smoke levels indicated by the LEDS can easily be calibrated in any desired units, such as Ringelman numbers, to give direct indications of smoke levels in the flue. If a six-gate design is used, then finer gradations of smoke calibration are made possible.

In the above, operational amplifiers 34, 36, 38 40, 42 and 44 form a special (quasi) analog to digital converter. Unless otherwise noted the upper input to these operational amplifiers is always the positive input, while the lower input is always the negative input.

When these operational amplifiers are connected in an open loop manner (i.e. no feedback resistor), they act as voltage comparators. Their operation is as follows. If the input voltage on an operational amplifiers positive input is greater than the input voltage on its negative input, then the output assumes a positive voltage state (assuming the operational amplifiers are also running on a plus and minus 6 volt supply). If the opposite case applies, then the output assumes a negative voltage.

The resistor divider chain 62, 60, 48, 50 gives various output voltages depending on their values. Assuming, for example, that they are all 1,000 ohm resistors, the voltage at the junction of resistors 48 and 50 would be plus 3 volts and the voltage at the junction of 62 and 60 would be minus 3 volts. These voltages are reasonably accurate because the operational amplifiers draw virtually no current at their input terminals. Thus, all the current through the divider resistors is constant.

Examination of the circuit shows that operational amplifier 44 would have plus 3 volts applied to its negative input terminal. As a result, the output of this operational amplifier will switch positive when positive input terminal voltage exceeds plus 3 volts.

For operational amplifier 32, because the negative input terminal is tied to ground, its output will go positive whenever the voltage at the positive input terminal goes above ground. It is to be understood that for these operational amplifiers, the output will return to the negative state if the positive terminal voltage ever dips below the negative terminal input voltage.

To summarize

| Output of operational amplifier | Goes positive when amplified photocell voltage | and | goes negative when amplifier photocell voltage |
|---|---|---|---|
| 34 | exceeds +3 volts | | goes below +3 volts |
| 36 | exceeds ground potential | | goes below ground |
| 38 | goes below +3 volts | | goes above +3 volts |
| 40 | exceeds −3 volts | | goes below −3 volts |
| 42 | goes below ground | | goes above ground |
| 44 | goes below −3 volts | | goes above −3 volts |

Operational amplifiers are very accurate for this purpose, and the switching generally occurs within a few millivolts accuracy. The result of this is the following:

If the output of operational amplifier 34 is positive, then the amplified photocell voltage exceeds +3 volts. If the outputs of both operational amplifiers 36 and 38 are positive, the amplified photocell voltage is between zero and +3 volts. If the output of both operational amplifiers 40 and 42 are positive, the amplified photocell voltage is between zero and −3 volts. If the output of operational amplifier 44 is positive, the amplified photocell voltage is less than −3 volts.

Clearly the output of the amplifier 22 must fall into only one of four possible regions. This is why this circuit is a quasi-analog to digital converter.

Devices 70, 72, 74 and 76 are, for example, RCA C/MOS NAND gates. They are logic elements commonly used by designers to perform an "and" type decision. Their operation is as follows: The output voltage switches from a positive level to a negative level if and only if both inputs are simultaneously positive.

If a positive voltage level is defined as a "1" and a negative voltage level as a "0" then the truth table for the NAND gate appears below. Note that the output only changes to a "0" (negative) voltage when both inputs A and B are at "1's". Any other input condition results in a logic "1" output.

TRUTH TABLE

| Inputs | | Outputs |
|---|---|---|
| A | B | C |
| 0 | 0 | 1 |
| 1 | 0 | 1 |
| 0 | 1 | 1 |
| 1 | 1 | 0 |

If both NAND gate inputs are tied together, than the logic element functions as an inverter. The middle two truth table conditions are impossible and the simplified bottom truth table results as follows:

| Input | Output |
|---|---|
| 0 | 1 |
| 1 | 0 |

C/MOS NAND gates have switching times of about 500 nanoseconds (500 billionths of a second).

The four outputs of the C/MOS NAND gate form the output of the *a/d* converter:

| Output of NAND gate number | goes low when the amplified smoke level is |
|---|---|
| 70 | greater than 3 volts |
| 72 | between 0 and 3 volts |
| 74 | between 0 and −3 volts |
| 76 | less than −3 volts. |

The output of the quasi analog-to-digital converter, which is a digital representation of the level of smoke that the photocell has detected, enters some stages of buffering. This is required because the signals out of the C/MOS NAND gates are of too low a level. Operational amplifiers 78, 80, 82 and 84 perform this buffering. Other means of buffering are possible.

The operational amplifier buffers amplify without inversion of the *a/d* signals. Thus only one buffer output can be negative at any one time. This signal level is now of sufficient drive to power the LEDS (light emitting diodes) and transistors.

The transistors act as a current switch and steers current into one of four triacs. Each of the four possible *a/d* outputs drives a unique triac.

The triac can be looked upon as an a.c. switch. Whenever current is steered into its gate terminal, it will conduct between its anode and cathode. An analogous mechanical system could use relays instead of triacs without any performance degradation, however, reliability is improved by the use of triacs.

The result of this triac switching is an amplitude varying sine wave, whose amplitude may be one of two possible levels. As the amplified smoke voltage passes through the four *a/d* regions (less than −3, between −3 and 0, between 0 and +3 and greater than +3 volts), a different triac is energized and the input sine wave on point 118 is switched to "either a point on the series resistors between resistor 106 and 108, or between resistors 114 and 116, the first being the indication of too little obscuration at the photocell 8, and the latter being the indication of too great obscuration".

Figure 2:
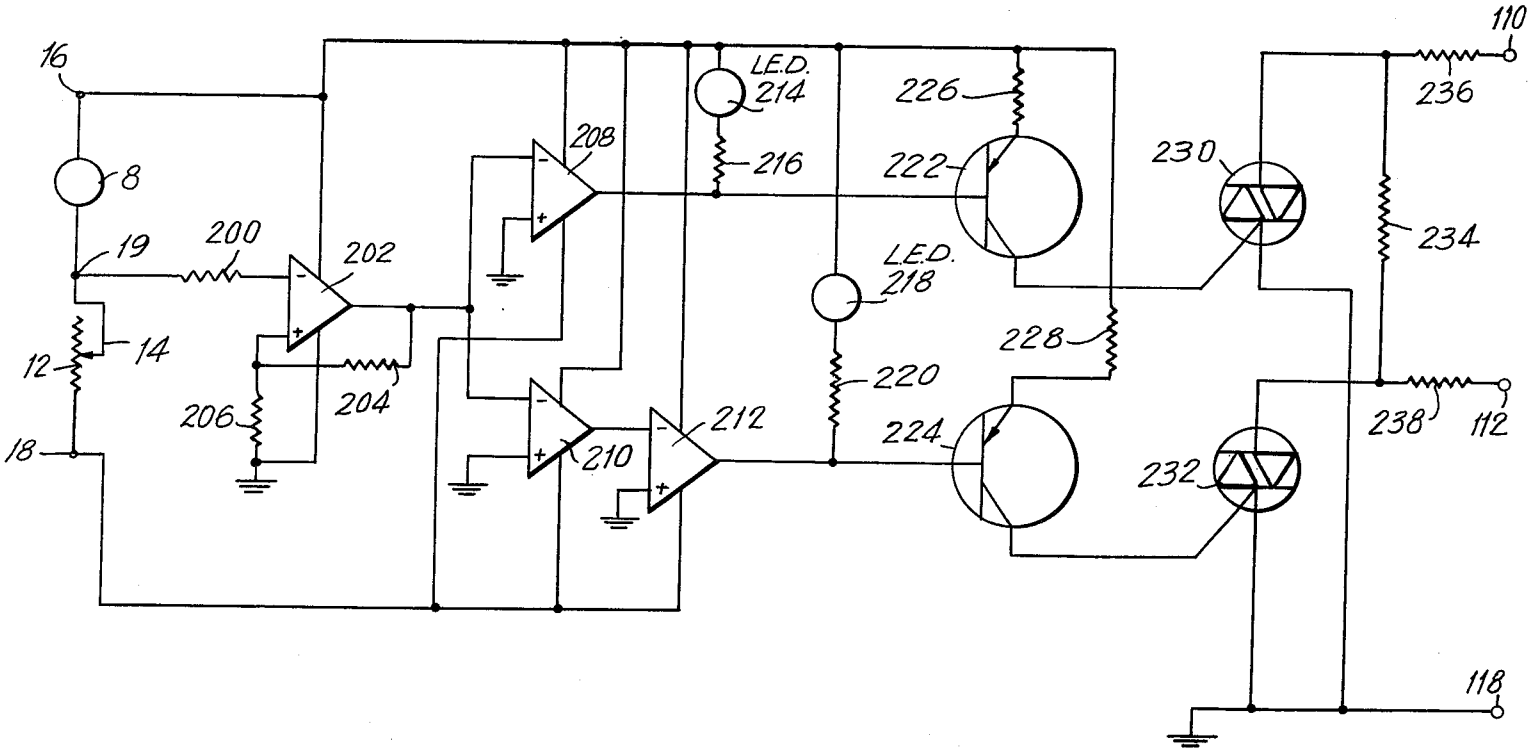
FIG. 2 shows a further embodiment of the invention in the form of a modified electronic circuit.

In FIG. 2, another smoke control circuit is shown. In this circuit, the voltage appearing at junction 19, as previously described, is connected through resistor 200 to operational amplifier 202, which performs both an amplifier and comparator function. Switching action takes place depending on the input from junction point 19, so as to give either plus 6 volts or minus 6 volts at the output of the comparator-amplifier 202. Resistors 204 and 206 form a resistor network to provide necessary hysteresis at the threshold voltage.

The output of operational amplifier 202 is fed to operational amplifiers 208 and 210 which separate and amplify the output signals from operational amplifier 202. The output of operational amplifier 210 is inverted for proper phasing by operational amplifier 212. The output of operational amplifier 208 is fed to transistor 222 and to light emitting diode 214. The output of operational amplifier 212 is fed to transistor 224 and LED 218. Resistors 216 and 220 are current limiters for proper LED operation. Resistors 226 and 228 perform this function for transistors 222 and 224.

The output of transistor 222 is fed to triac 230, and the output of transistor 224 is fed to triac 232. The outputs of triacs 230 and 232 are applied across resistors 234, 236 and 238 and then to terminals 110, 112 and 118 and then to terminals 110, 112 and 118 and then to motor M as previously described.

The advantages of the circuit of FIG. 2 over that of FIG. 1 and that of said copending application are simplicity and lower cost. As in the circuit of FIG. 1, the motor M will follow the signal of photocell 8, changing its direction as the voltage at junction point 19 causes the output of operational amplifier 202 to go either plus or minus.

As a further variation on the circuit of FIG. 2, resistor 234 may be eliminated and output terminals 110, 112 and 118 connected to a Honeywell series 600 "floating control" motor, or a similar type motor, rather than the 900 series modulating control motor referred to in the copending application. The resulting operation will be the same in either case. Motor M should be a slow speed motor, a 2 minute or 4 minute rating being preferred to the usual 30 second or 60 second motor, in order to reduce hunting in the response of the entire system.

Referring back to FIG. 1 described hereinabove, a principal difference between that circuit and the circuit described in my prior copending application is that the triacs 98, 100 and 102 have outputs which are connected in common to the bridge inclusive of the potentiometer P. This means that the triac switch 96 operates in one direction to indicate, for example, that the smoke is too clean that the motor M should operate in a direction to control the control 4 to change the conditions of combustion in the chamber 6. On the other hand, triac switches 98, 100 and 102 function under various levels of conditions wherein the density of the smoke in the flue 2 is too great, but these triacs all operate to place the same voltage at terminal 262 so that the operation of any one of these triac switches has the same effect of closing the motor M to operate in the same direction to that caused by the presence of a signal at the terminal 260. This provides for a continuous operation of the motor M in one direction or the other and not in increments as was the result when the equivalent triacs in the previously disclosed circuit operated sequentially and separately to make the motor M move in a manner which was more discrete and incremental.

In the circuit of FIG. 1, the use of three separate triacs 98, 100 and 102 as well as the associated gates is intended to provide a source of actuation for the light emitting diodes 81, 83 and 85. Thus, although the triac switches 98, 100 and 102 all function to drive the motor M in the same direction, the associated gates cause the lighting of respective of the light emitting diodes which therefore indicate just how severe the condition of too great a density of combustion products actually is. It is possible, by well known methods, to locate at remote positions, duplicates of the LEDs so as to give a visual indication of the smoke condition occurring in the controlled apparatus from moment to moment at the remote location or locations. The advantages of such instantaneous read-outs of smoke conditions at a remote location from the controlled apparatus are significant.

Figure 3:
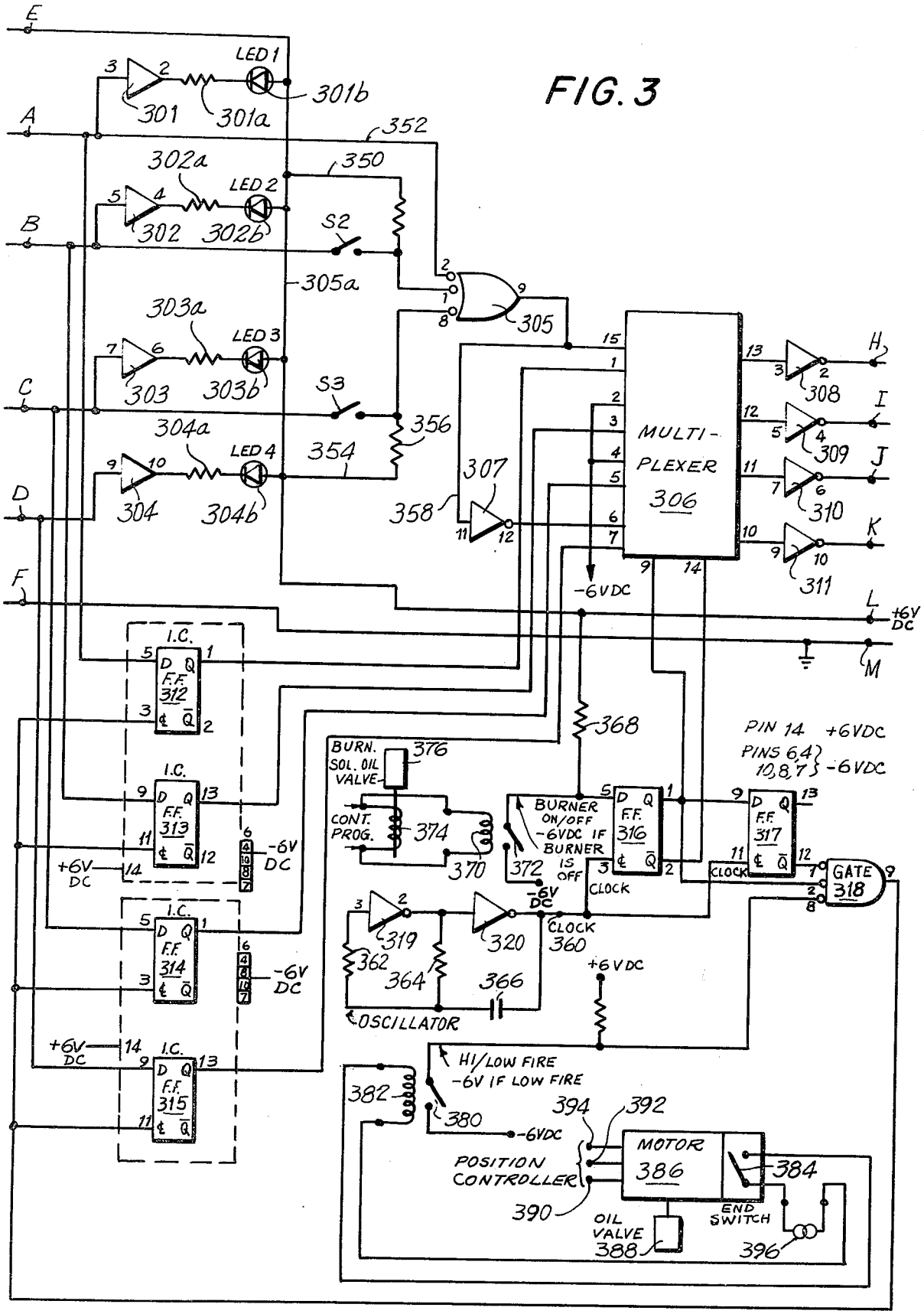
FIG. 3 is a schematic circuit of a still further embodiment.

Under certain circumstrances, it is desirable to record the signal level generated by the photoelectric cell which is employed for smoke detection and to use the remembered or stored signal levels by substituting the same for subsequent signal levels in order to provide a more efficient type of operation. Thus, for example, it may be desirable to remember the signal level at a prior starting up process in order to return the motor and associated controls to the same position for purposes of a subsequent starting up procedure. This will, of course, mean that intervening conditions such as may occur during a shutting off of the fire during a high-fire operation should not be stored or remembered and provisions should be made accordingly. Such a circuit is schematically represented in FIG. 3 wherein the illustrated circuitry is intended to operate with an input and output as appears in FIG. 7 (*a*) of the above mentioned copending application Ser. No. 426,323.

In FIG. 3 appears input terminals A, B, C, D, E and F. terminals A, B, C and D are respectively fed input signals from the gates 220, 222, 224 and 226 of FIG. 7 (*a*) of said copending application. Terminal E is connected to line 176 of FIG. 7 (*a*) of said copending application and terminal F is connected to the grounded junction 202 of said copending application.

Terminal A is connected to a buffer 301 and terminals B, C and D are respectively connected to buffers 302, 303 and 304 respectively. To the output terminals of buffers 301, 302, 303 and 304 are respectively connected resistors 301(*a*), 302(*a*), 303(*a*) and 304(*a*), and to these resistors are respectively connected light emitting diodes 301(*b*), 302(*b*), 303(*b*) and 304(*b*j.

These light emitting diodes are all connected to line 305(*a*) which is also connected to terminal E.

Light emitting diodes 301(*b*) and 302(*b*) are furthermore connected via line 350 to terminal 1 of buffer 305

(R.C.A. CD 4023 or equivalent) whose output terminal is indicated at 9. Terminal A is connected via line 352 to terminal 2 of buffer 305 whereas terminal 8 of this buffer is connected via line 354 and resistor 356 to the light emitting diodes 303(*b*) and 304(*b*).

The output terminal of buffer 305 is connected to terminal 14 of multiplexer 306 (R.C.A. CD 4019 or equivalent). The output terminal of buffer 305 is moreover connected via line 358 to buffer or inverter 307 and thence to input terminal 6 of the aforesaid multiplexer 306.

Input terminals A, B, C and D are furthermore connected to integrated circuits 312, 313 and 314 and 315, these integrated circuits constituting flip flop circuits, each having input terminals indicated at D and output terminals indicated at $\tilde{Q}$. Clock signals are received at input terminals C L. The output terminals of flip flops 312 and 314 are indicated at 1 and 2 whereas the input terminals thereof are indicated at 5 and 3. The output terminals of flip flops 313 and 315 are indicated at 12 and 13 whereas the input terminals are indicated at 9 and 11.

The D input terminals of flip flops 312, 313, 314 and 315 are respectively connected to input terminals A, B, C and D. The output terminals of these flip flops are respectively connected to input terminals 1, 3, 5 and 7 of multiplexer 306. It thus appears that the multiplexer 306 may receive signals either from light emitting diodes 301(*b*), 302(*b*), 303(*b*) and 304(*b*) on the one hand while the flip flops 312, 313, 314 and 315 on the other hand.

The outputs of multiplexer 306 are indicated at 10, 11, 12 and 13 which are connected in inverse order to buffers or amplifiers 308, 309, 310 and 311. The outputs of these buffers are respectively connected to output terminals H, I, D and K which are respectively connected to the bases of the transistors 238, 340, 242 and 244 as appears in FIG. 7(*a*) of said copending application, Ser. No. 426,323. It will also be noted that the output terminal M which is connected by a line 236 to input terminal F is further connected to the terminal 268 in FIG. 7(*a*) of the aforesaid copending application.

Further flip flops are indicated at 316 and 317, the input terminal line of flip flop 317 being connected to the output terminal 1 of flip flop 316. Terminals 3 and 11 of flip flops 316 and 317 are respectively supplied at clock impulses from the clock terminal 360. These clock pulses are generated by the arrangement of oscillator elements 319 and 320 connected in a circuit further including resistors 362 and 364, as well as a capacitor 366.

The input at terminal 5 of flip flop 316 is connected via resistor 368 to the aforesaid described light emitting diodes as well as to terminal L(+ 6 volts).

A solenoid is employed which includes winding 370 as well as switch contact 372 (− 6 volts) which closes the circuit between a 6-volt supply connected to terminal 374 and the input at terminal 5 of flip flop 316. The solenoid winding 370 receives an input from across the winding 374 which operates the burner solenoid oil valve as indicated at 376. The signal applied to winding 374 is the fuel on-off signal from the burner control programmer.

The $\overline{Q}$ signals from flip flops 316 and 317 are fed to terminal 14 of multiplexer 306 and terminal 1 or NOR gate 318 respectively. Output terminal 1 of flip flop 316 is furthermore connected to input terminal 9 of the multiplexer 306, as well as to terminal 2 of gate 318. A further input to gate 318 is derived from switch contact 380 of the solenoid whose winding is indicated at 382, the signal to winding 382 being provided by end switch 384 of motor 386 (which operates oil valve 388) and whose input signals arrive at terminals 390, 392 and 394, all as heretofore described in said copending application, Ser. No. 426,323. It will be noted that end switch 384 couples an AC signal generated by 396 to the winding 382.

As previously described with reference to said copending application, a photocell 92, amplifier 172 and analog to digital network consisting of resistors and circuit components 184, 186, 188, 190, 192, 194, 220, 222, 224 and 226 are employed along with triacs and transistors 238, 240, 242, 244, 248, 250, 246 and 252 for purposes of generating output signals, all as has been described in copending application Ser. No. 426,323.

In the circuitry illustrated in FIG. 3 of the present application, buffers 301, 302, 303 or 304 buffer the four digital words possible from the analog to digital converter to drive light emitting diodes depending upon the level of smoke which is present.

The circuit elements 312, 313, 314 and 315 are called D flip flops and these flip flops serve as memory or storage elements. These flip flops will store whatever word is present at their D inputs (pins 5 or 9) whenever a clock pulse appears on pins 3 or 11. These flip flops will store the data indefinitely as long as power is applied thereto or until the next clock circuit pulse occurs.

Flip flop circuit elements 316, 317 and AND GATE 318 develop a clock pulse on every low-fire shutdown. If the burner is shut down at high-fire, it does not develop this clock pulse. This provides for memorizing the condition occurring at the previous shut-down as contrasted to remembering the conditions present when shutdown occurs at high-fire. Accordingly, the memory elements store the digital word indicating the smoke level present at the last low-fire shutdown.

Circuit element 316 stores the on-off condition of the burner and the output of this element (pins 1 and 2) control the multiplexer 306 operating as an 8-line input to a 4-line output multiplexer. In operation when the burner is on, multiplexer 306 operates as next indicated hereinbelow.

Signals present on the input pins 15, 2, 4 and 6 appear on pins 13, 12, 11 and 10, respectively. When the burner is off, the multiplexer is switched so that the inputs 1, 3, 5 and 7 are connected to the output pins 13, 12, 11 and 10, respectively. The multiplexer 306 therefore acts as a 4 pole double-throw switch allowing the transmission of the stored memory data or of the current smoke condition to control the associated triacs. Inverters 308, 309, 310 and 311 buffer the signal which is sent to the base of the driver transistors as has been previously described.

As a free running oscillator, the circuit including elements 319 and 320 provide timing sources in order to control these events.

When the associated burner is on, the multiplexer 306 allows only triacs 246 or 252 to be switched. The other triacs are held in off condition. In this fashion, it operates similarly to the simplified two gate system which has been described hereinabove in the present text.

The two gate system provides closer control of the smoke levels and its chief disadvantage is that when the burner goes off, the modulating motor goes to full-on state, believing that the smoke is too clean. This circuitry will force the motor, when the burner is off, to assume the setting of the last low-fire shutdown. Thus, upon the next turning on of the apparatus, the oil and air valves will be set for a smoke condition based on prior experience as remembered or stored in the memory elements 312, 313, 314 and 315.

Also appearing in the circuitry are switches S-2 and S-3. These allow the operator to select additional clean fire conditions if desired.

As has been noted previously, the system is by no means limited to a 4 bit system but can easily be expanded to any word length.

There will now be obvious to those skilled in the art many modifications and variations of the combustion controls disclosed hereinabove. These modifications and variations will not depart from the scope of the invention if defined by the following claims.

What is claimed is:

1. Smoke control apparatus comprising a combustion chamber, means for supplying fuel and oxygen containing gas into said chamber, means for venting the products of combustion from said chamber, smoke accumulating means for amplifying the density of said products of combustion to facilitate the detecting and measuring of the same, photoelectric means providing an electrical signal in accordance with the thusly amplified density of the products of combustion, electrical circuit means for processing said electrical signal, and servo-mechanism means operated by said circuit means to control the means for supplying fuel and oxygen containing gas to optimize the supply thereof and therefore said density; said circuit means comprising bridge means to control said servo-mechanism means, at least one first electronic switch operable when said density is equal to or less than a predetermined standard, at least one second electronic switch operable when said density is greater than said standard, said switches being coupled to and operating said bridge means, and further means coupled to and operating said bridge means, and further means coupled to said photoelectric means and to said switches to operate the latter in response to levels of said signal whereby to control said servo-mechanism means through said bridge means.

2. Apparatus as claimed in claim 1 wherein said further means include gates.

3. Apparatus as claimed in claim 1 comprising a potentiometer coupled to said photoelectric means to constitute a signal-level adjustment means therewith.

4. Apparatus as claimed in claim 2 comprising an amplifier including a signal-level adjustable feedback means, said amplifier being coupled between said adjustment means and gates.

5. Apparatus as claimed in claim 2 comprising visual indicators coupled to said gates to give indicaions of said density.

6. Apparatus as claimed in claim 1 comprising a plurality of resistors coupled in a voltage dividing network to said photoelectric means and a plurality of amplifiers connected in parallel to said network to pass different levels of signals.

7. Apparatus as claimed in claim 5 comprising a plurality of Nand gates coupled to said amplifiers and a plurality of transistors coupling said Nand gates to said switches.

8. Apparatus as claimed in claim 6 wherein said switches are triacs.

9. Apparatus as claimed in claim 1 wherein there are a plurality of second switches having outputs connected in common to said bridge means.

10. Apparatus as claimed in claim 1 wherein said bridge means includes a resistor connected between said switches.

11. Apparatus as claimed in claim 1 comprising means to remember said levels and for selectively substituting the thusly remembered levels for subsequent levels.

12. Apparatus as claimed in claim 11 wherein the last said means includes means whereby said levels are remembered at low fire shut down and not at high fire shutdown.

* * * * *